US010493762B2

(12) United States Patent
Sato et al.

(10) Patent No.: US 10,493,762 B2
(45) Date of Patent: Dec. 3, 2019

(54) INKJET PRINTING APPARATUS

(71) Applicant: CANON KABUSHIKI KAISHA, Tokyo (JP)

(72) Inventors: Noriko Sato, Kawasaki (JP); Hiroshi Nakai, Sagamihara (JP); Yoshinori Nakagawa, Kawasaki (JP); Takatoshi Nakano, Yokohama (JP); Atsushi Takahashi, Tama (JP); Takuya Fukasawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/027,552

(22) Filed: Jul. 5, 2018

(65) Prior Publication Data

US 2019/0009548 A1 Jan. 10, 2019

(30) Foreign Application Priority Data

Jul. 7, 2017 (JP) ..... 2017-133585

(51) Int. Cl.
*B41J 2/165* (2006.01)

(52) U.S. Cl.
CPC ..... *B41J 2/1652* (2013.01); *B41J 2/16505* (2013.01); *B41J 2/16508* (2013.01); *B41J 2/16517* (2013.01); *B41J 2/16523* (2013.01); *B41J 2/16526* (2013.01); *B41J 2/16532* (2013.01); *B41J 2/16588* (2013.01)

(58) Field of Classification Search
CPC .. B41J 2/1652; B41J 2/16523; B41J 2/16526; B41J 2/16505
USPC ..... 347/29–31
See application file for complete search history.

(56) References Cited

U.S. PATENT DOCUMENTS

| | | | |
|---|---|---|---|
| 5,835,109 | A | 11/1998 | Uchida |
| 6,984,009 | B2 | 1/2006 | Nakagawa et al. |
| 6,994,416 | B2 | 2/2006 | Seki et al. |
| 7,011,386 | B2 | 3/2006 | Iwasaki et al. |
| 7,114,795 | B2 | 10/2006 | Shimura et al. |
| 7,396,095 | B2 | 7/2008 | Nakagawa et al. |
| 7,896,463 | B2 | 3/2011 | Nakagawa et al. |

(Continued)

FOREIGN PATENT DOCUMENTS

| | | | |
|---|---|---|---|
| JP | 06328703 | A | 11/1994 |
| JP | 2005262822 | A | 9/2005 |
| JP | 2010173205 | A | 8/2010 |

OTHER PUBLICATIONS

U.S. Appl. No. 16/024,973, filed Jul. 2, 2018 (first named inventor: Takuya Fukasawa).

*Primary Examiner* — An H Do
(74) *Attorney, Agent, or Firm* — Venable LLP

(57) ABSTRACT

There is provided an inkjet printing apparatus having a configuration of capping and sucking an ejection opening surface for ejecting a plurality of types of inks by using one cap member, in which the inks in the cap member can be sucked and removed evenly. To achieved this, a cap member is provided with a suction opening for externally discharging ink absorbed by an absorber in the cap member. The suction opening is formed in a position where the suction opening does not face first ejection openings for ejecting ink that may not easily stagnate and faces the second ejection openings for ejecting ink that may easily stagnate in a case where the cap member caps an ejection opening surface.

11 Claims, 13 Drawing Sheets

(56) References Cited

U.S. PATENT DOCUMENTS

| | | | | |
|---|---|---|---|---|
| 8,152,267 | B2 * | 4/2012 | Yamaguchi | B41J 2/1652 347/30 |
| 8,540,341 | B2 * | 9/2013 | Yamamoto | B41J 2/16523 347/30 |
| 8,752,930 | B2 | 6/2014 | Doi et al. | |
| 8,827,419 | B2 | 9/2014 | Nakagawa et al. | |
| 8,944,562 | B2 | 2/2015 | Nakagawa et al. | |
| 9,096,065 | B2 | 8/2015 | Nakano et al. | |
| 9,446,595 | B2 | 9/2016 | Takarabe et al. | |
| 9,517,628 | B2 | 12/2016 | Tenkawa et al. | |
| 9,862,195 | B2 | 1/2018 | Genta et al. | |
| 2002/0033859 | A1 * | 3/2002 | Mitsuzawa | B41J 2/16505 347/23 |
| 2010/0194819 | A1 | 8/2010 | Tamaki | |
| 2016/0052278 | A1 | 2/2016 | Iwasaki et al. | |
| 2018/0001623 | A1 | 1/2018 | Nakano et al. | |
| 2018/0154630 | A1 | 6/2018 | Takahashi et al. | |

* cited by examiner

INKJET PRINTING APPARATUS

BACKGROUND OF THE INVENTION

Field of the Invention

The present invention relates to an inkjet printing apparatus having a print head that ejects ink and prints an image.

Description of the Related Art

An inkjet printing apparatus has a maintenance unit for an inkjet print head. The maintenance unit has a cap for protecting an ejection opening surface of a print head while ejecting operation is not performed and for receiving preliminarily ejected ink, a pump for sucking ink off the ejection opening surface via the cap, and the like.

Japanese Patent Laid-Open No. 2010-173205 discloses a cap for a line head and an internal structure of the cap for efficiently sucking received ink. More specifically, Japanese Patent Laid-Open No. 2010-173205 discloses caps prepared for respective types of inks and a structure of utilizing capillary force so that ink naturally moves toward a suction opening provided in the center of each cap.

Recently, downsizing of apparatuses has been proceeding, and there has been proposed a print head capable of ejecting a plurality of types (colors) of inks from a common ejection opening surface. In such a print head, since the ejection opening surface for ejecting a plurality of colors of inks is capped and sucked by using one cap, there is a situation in which the plurality of colors of inks are mixed within the cap.

Incidentally, properties of the plurality of colors of inks are different from each other, and the inks within the cap are not always distributed evenly. For instance, in a case where a viscosity of black ink is higher than that of other color inks, a portion including preliminarily ejected black ink tends to have stagnation of ink. In a case where preliminary ejection of black ink having a higher viscosity is performed more frequently compared to color ink, the stagnation becomes more apparent.

Accordingly, even if the inside of the cap has a structure of efficiently leading ink to the suction opening provided in the center of the cap as disclosed in Japanese Patent Laid-Open No. 2010-173205, stagnation of ink occurs in a specific portion due to a difference between ink that may easily flow to the suction opening and ink that may not easily flow. Further, if a viscosity of the stagnated ink increases over time, it becomes difficult to remove the thickened ink from the cap even if a predetermined negative pressure is applied via the suction opening.

SUMMARY OF THE INVENTION

The present invention has been made to solve the above problems. An object of the present invention is to provide an inkjet printing apparatus having a structure of capping and sucking the ejection opening surface for ejecting a plurality of colors of inks by using one cap, in which the inks in the cap can be sucked and removed evenly.

According to an aspect of the present invention, there is provided an inkjet printing apparatus comprising: a print head having an ejection opening surface on which first ejection openings for ejecting a first ink and second ejection openings for ejecting a second ink are arranged so as to correspond to the width of a print medium, the second ink having a higher viscosity compared to the first ink; a cap member capable of capping the ejection opening surface; an absorber located in the cap member for absorbing inks discharged from the first ejection openings and the second ejection openings; a suction opening formed on the cap member for discharging inks absorbed by the absorber: the suction opening being formed in a position where the suction opening does not face a region in which the first ejection openings are arranged and faces a region in which the second ejection openings are arranged in a case where the cap member caps the ejection opening surface; and a maintenance unit configured to maintain ejection performance of the first ejection openings and the second ejection openings, wherein in a state where the ejection opening surface and the cap member are located in a predetermined relative position, the maintenance unit performs preliminary ejecting operation for ejecting the first ink and the second ink respectively from the first ejection openings and the second ejection openings and suction operation for discharging inks absorbed by the absorber in the preliminary ejecting operation from the suction opening.

Further features of the present invention will become apparent from the following description of exemplary embodiments with reference to the attached drawings.

DESCRIPTION OF THE EMBODIMENTS

Figure 1:
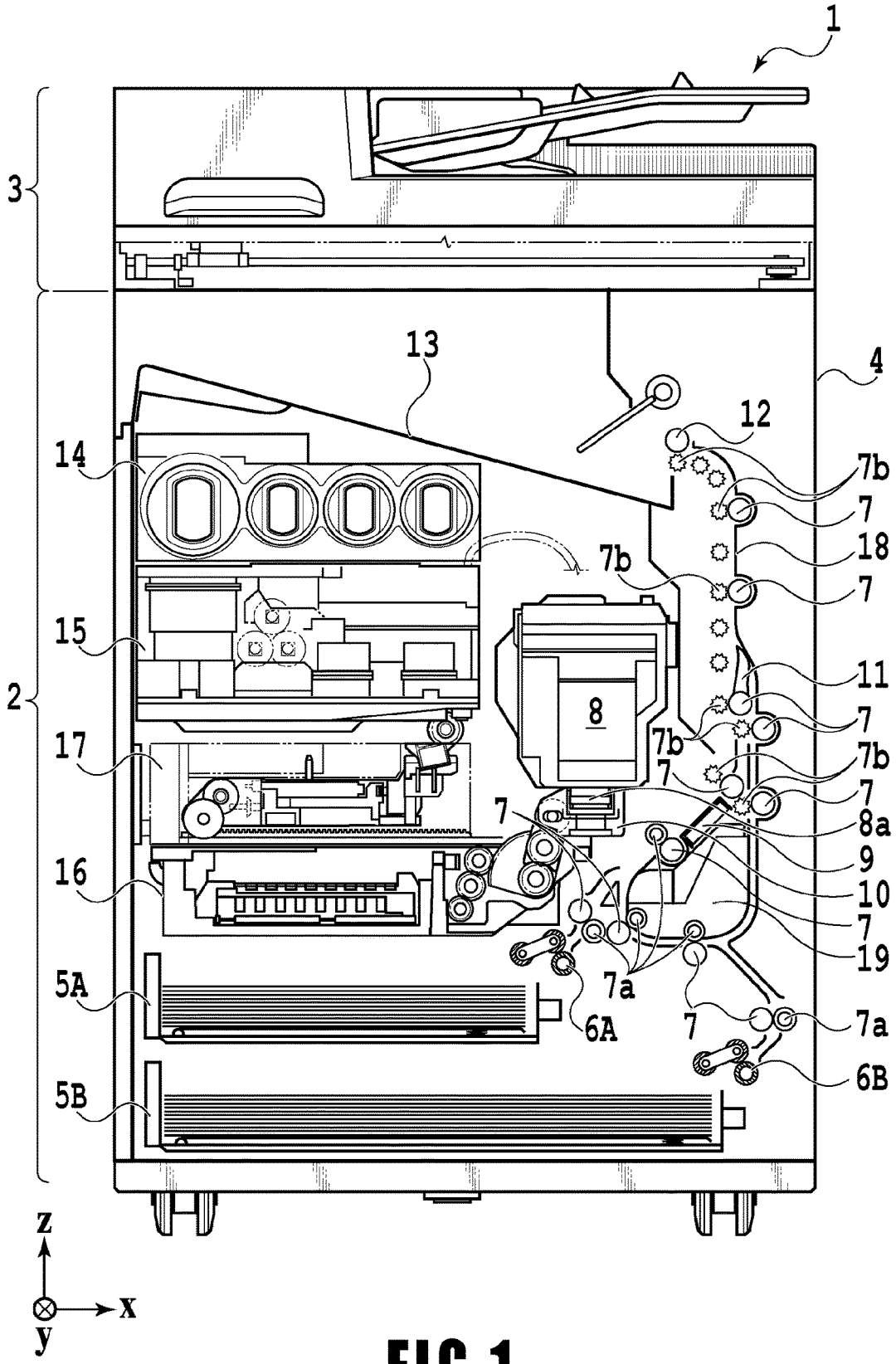
FIG. 1 is an internal configuration diagram of an inkjet printing apparatus 1.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform a maintenance operation for the print head 8. The maintenance operation will be described later in detail.

Figure 2:
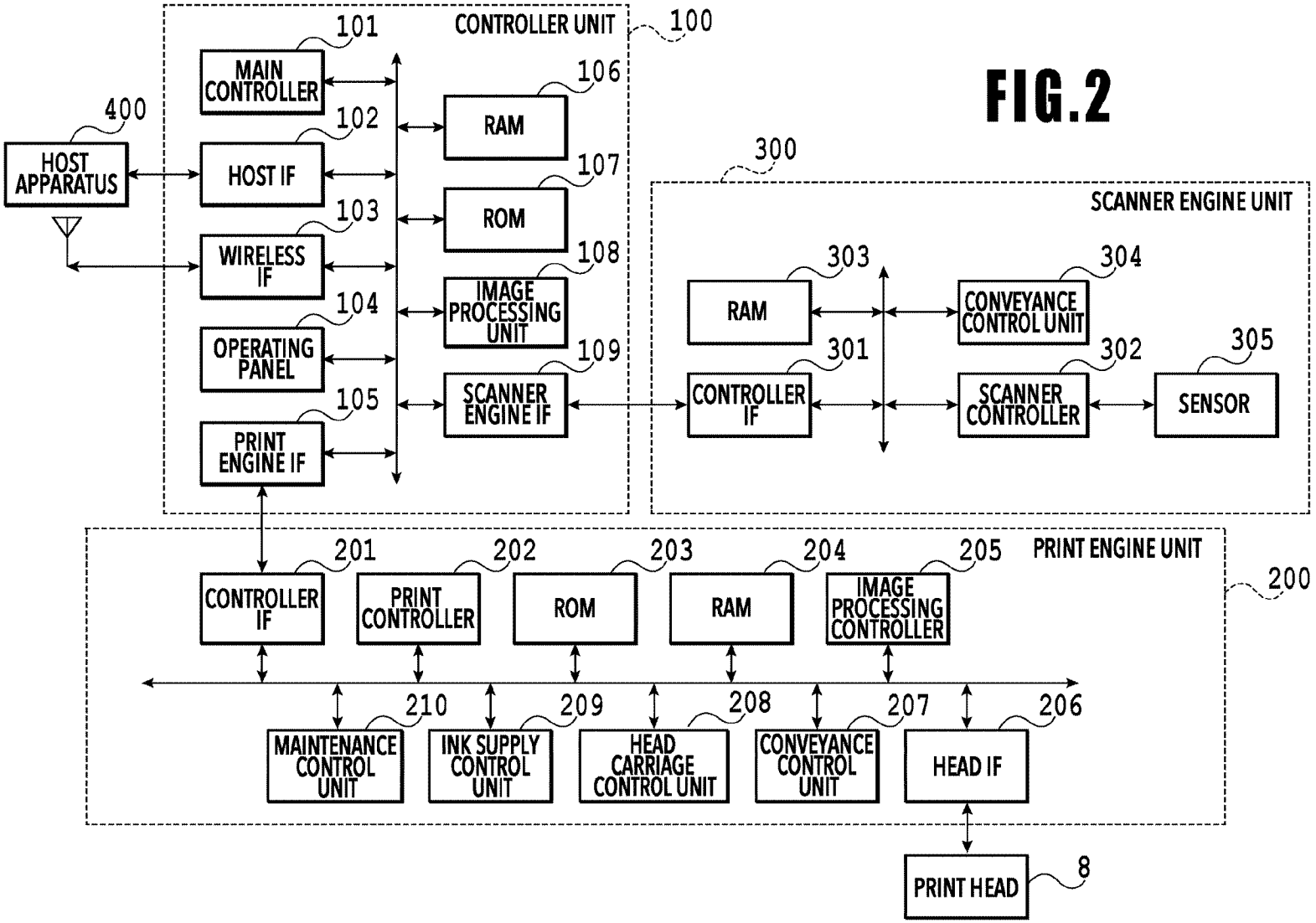
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
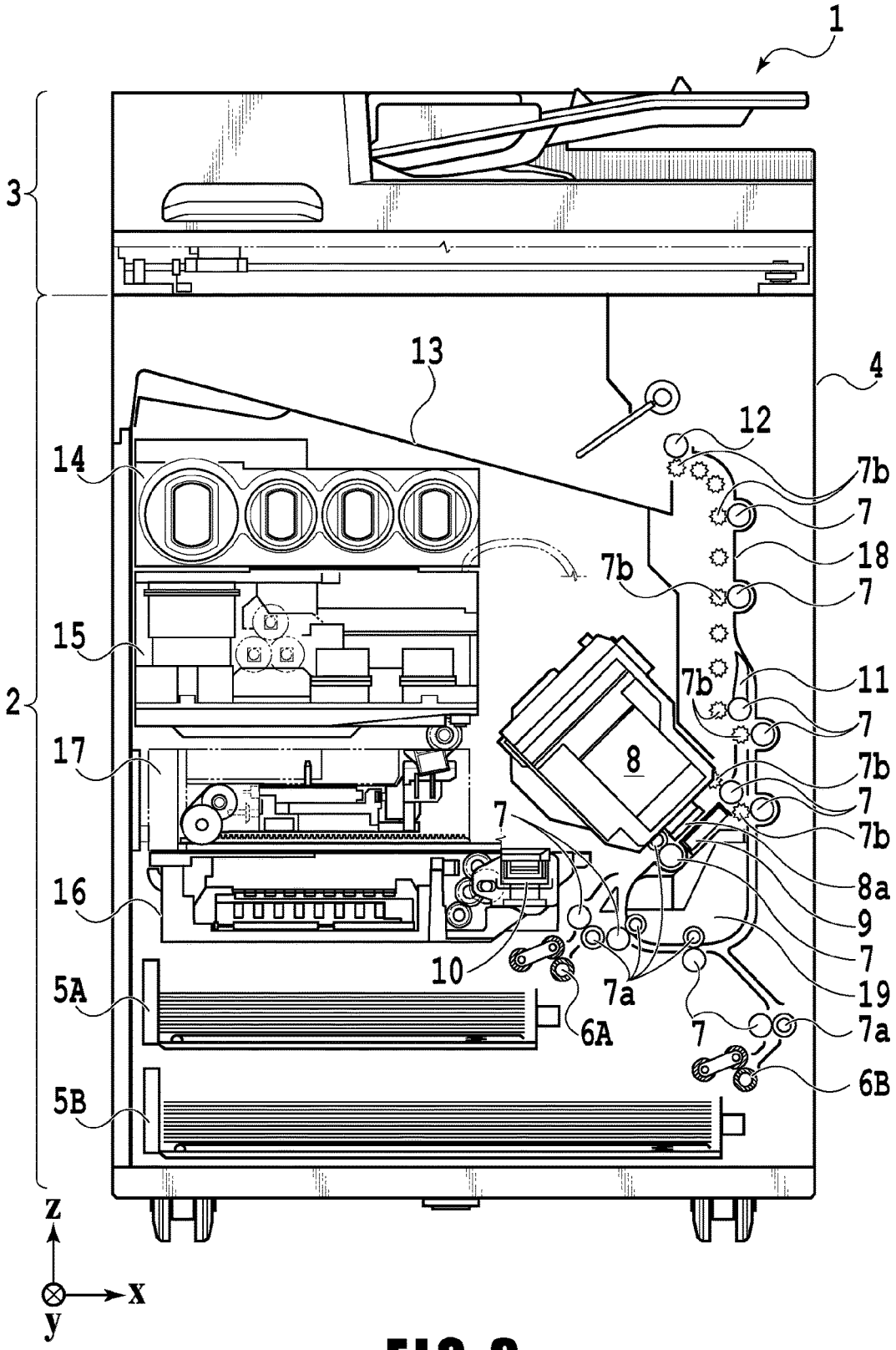
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
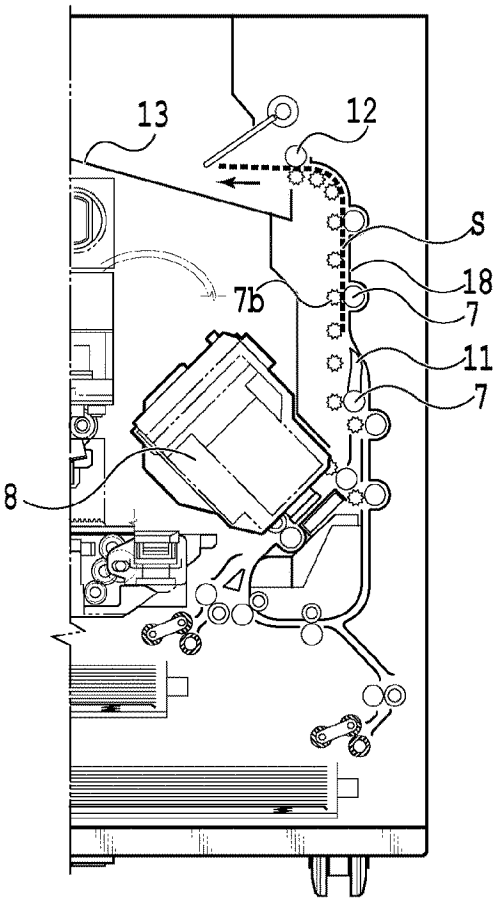
FIGS. 4A to 4C are conveying path diagrams of a print medium fed from a first cassette.
Figure 4B:
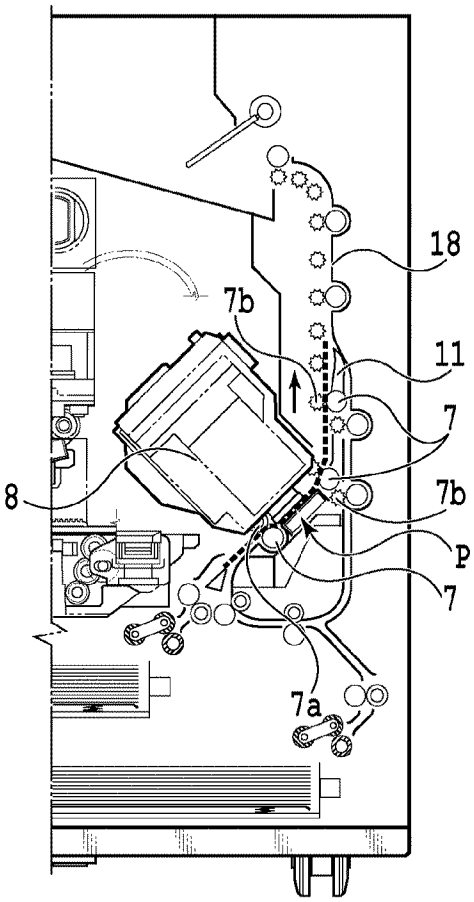
Figure 4A:
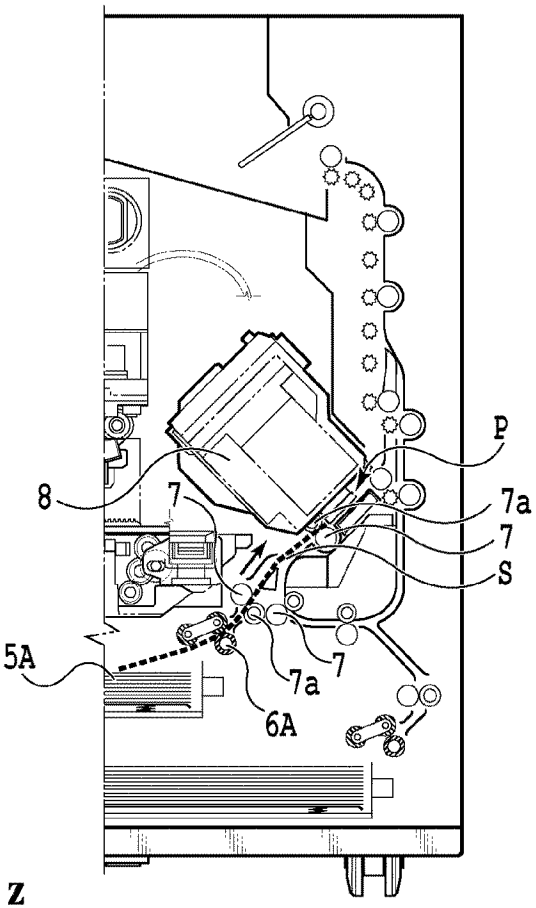

FIGS. 4A to 4C are diagrams showing a conveying path in the case of feeding an A4 size print medium S from the first cassette 5A. A print medium S at the top of a print medium stack in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
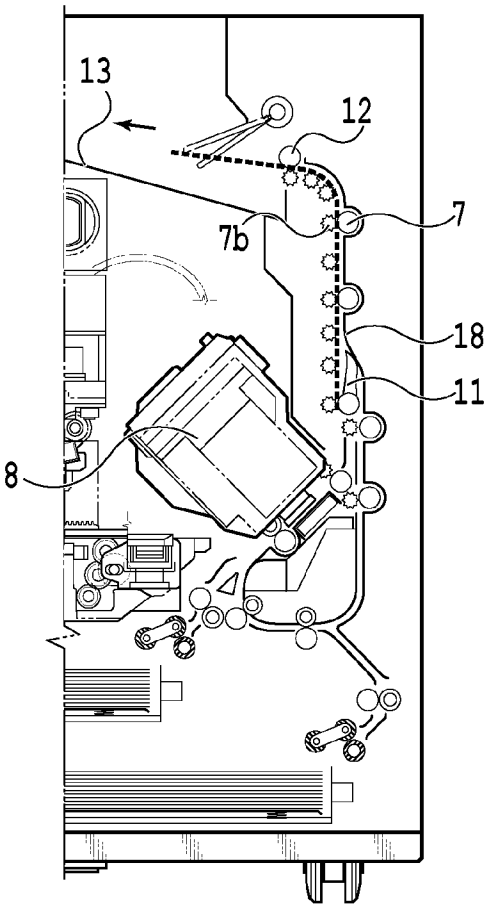
FIGS. 5A to 5C are conveying path diagrams of a print medium fed from a second cassette.
Figure 5B:
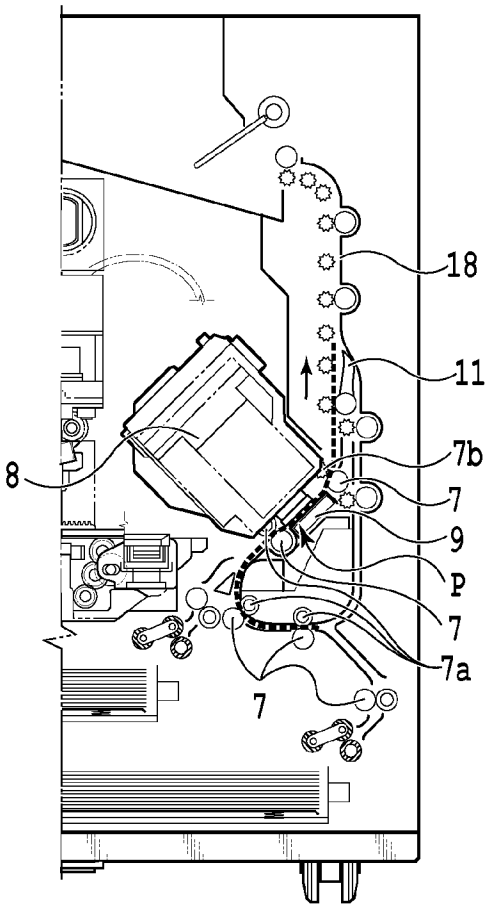
Figure 5A:
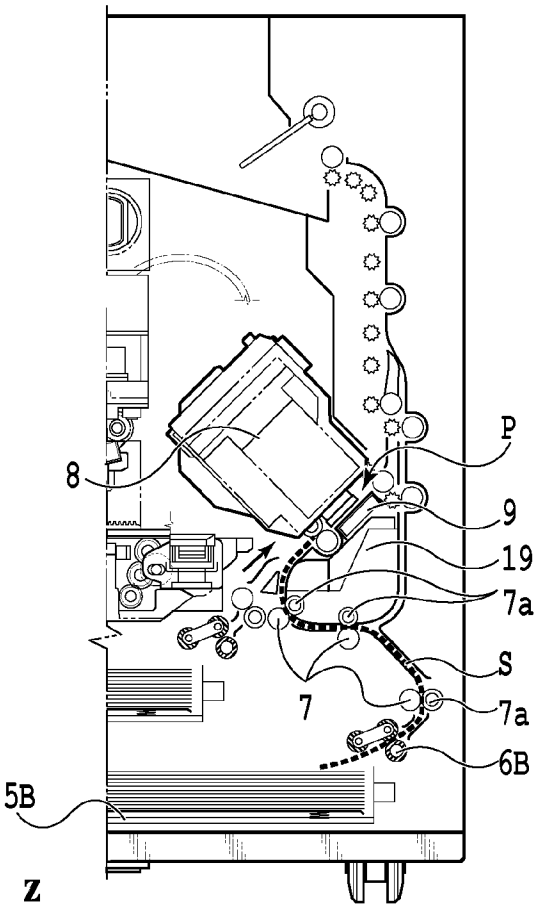

FIGS. 5A to 5C are diagrams showing a conveying path in the case of feeding an A3 size print medium S from the second cassette 5B. A print medium S at the top of a print medium stack in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
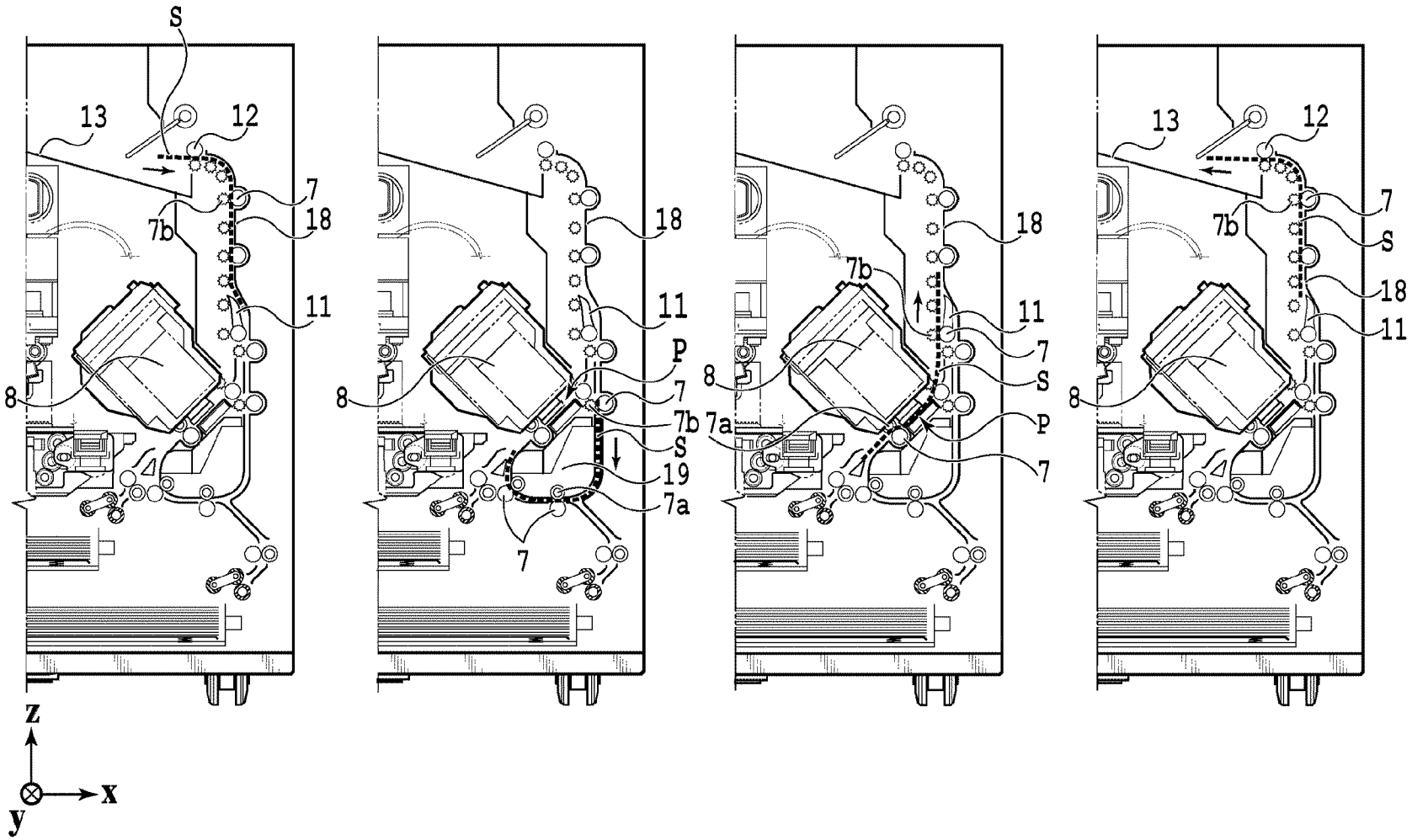
FIGS. 6A to 6D are conveying path diagrams in the case of performing print operation for the back side of a print medium.

After the print head 8 finishes print operation for the first side and the back end of the print medium S passes by the flapper 11, the print controller 202 turns the conveying rollers 7 reversely to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
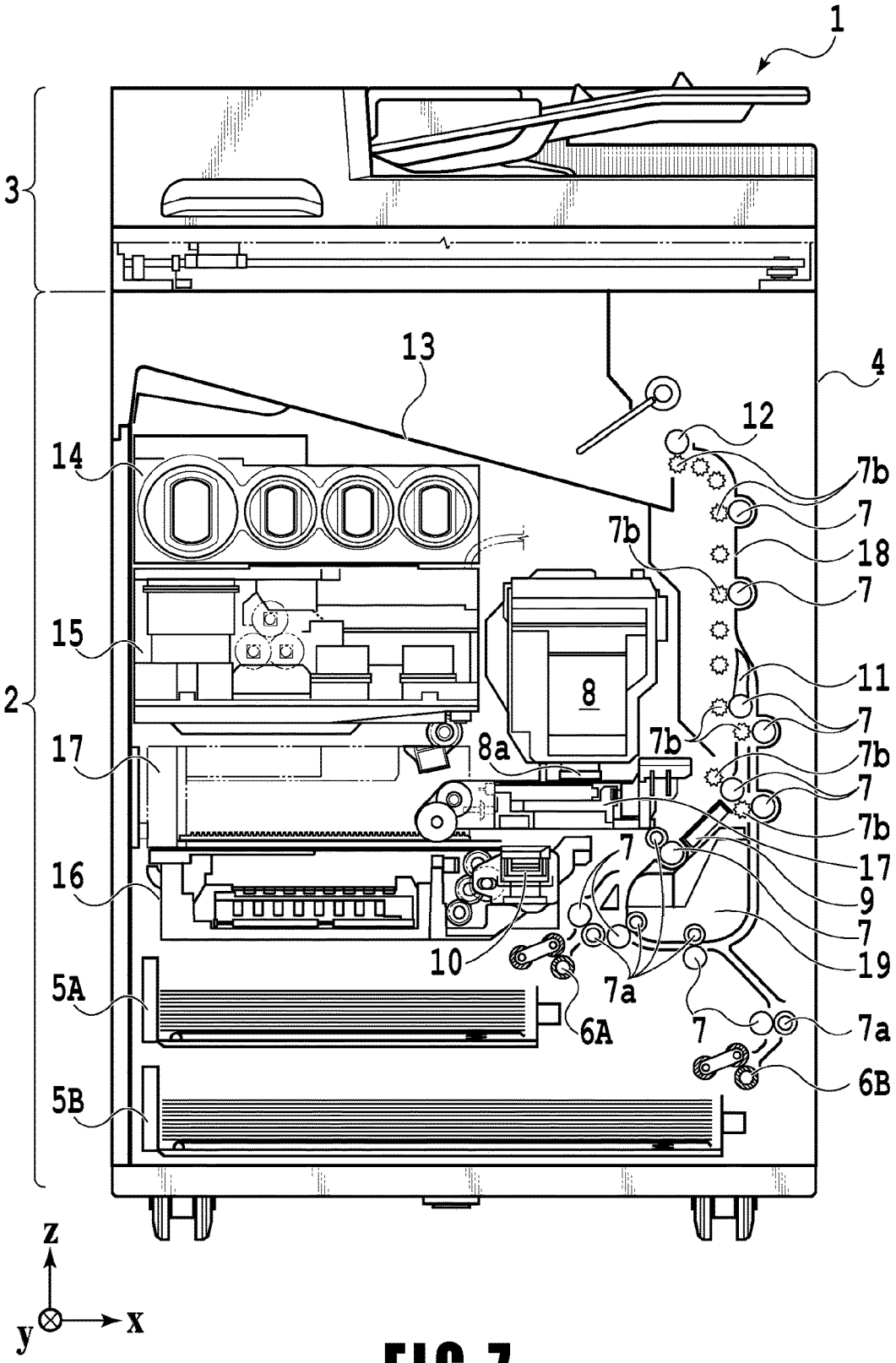
FIG. 7 is a diagram showing the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

Figure 8A:
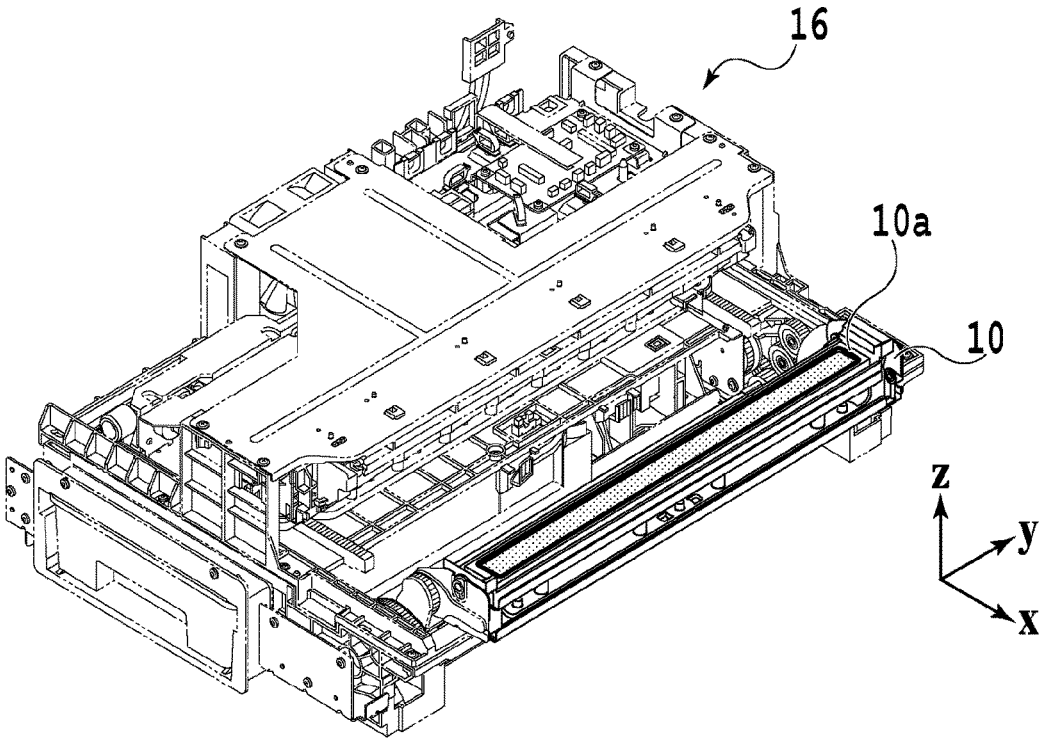
FIGS. 8A and 8B are perspective views showing the configuration of a maintenance unit.
Figure 8B:
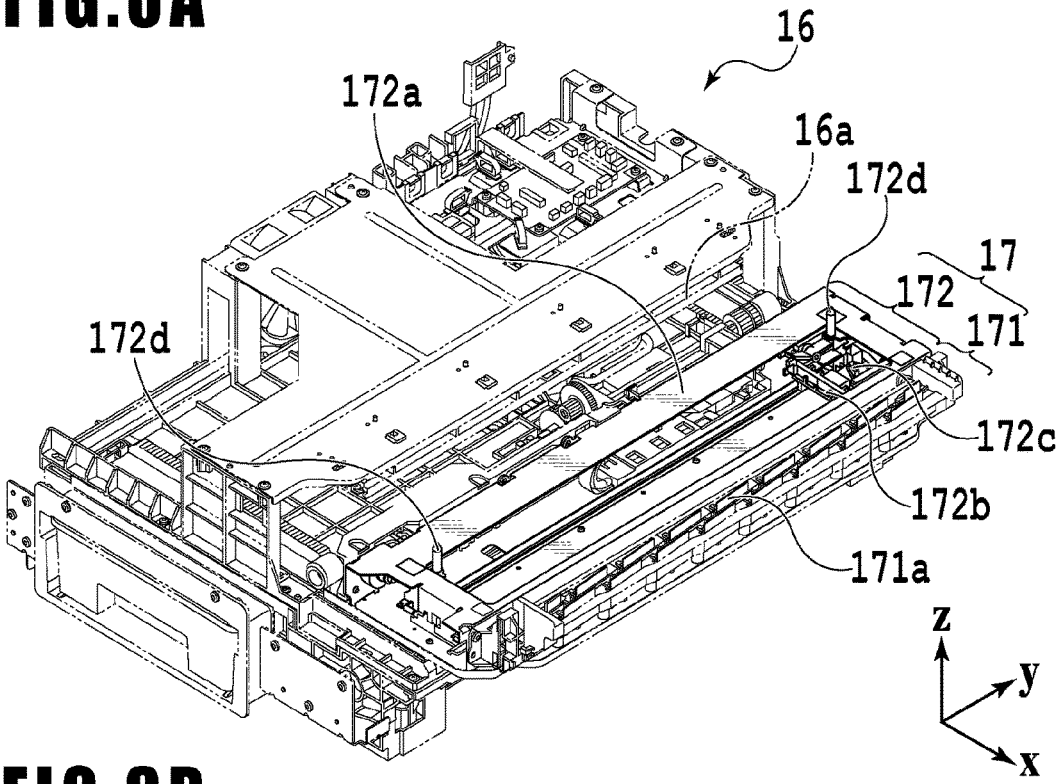

FIG. 8A is a perspective view showing the maintenance unit 16 in a standby position. FIG. 8B is a perspective view showing the maintenance unit 16 in a maintenance position. FIG. 8A corresponds to FIG. 1 and FIG. 8B corresponds to FIG. 7. When the print head 8 is in the standby position, the maintenance unit 16 is in the standby position shown in FIG. 8A, the cap unit 10 has been moved vertically upward, and the wiping unit 17 is housed in the maintenance unit 16. The cap unit 10 comprises a box-shaped cap member 10*a* extending in the y-direction. The cap member 10*a* can be brought into intimate contact with the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink.

On the other hand, in the maintenance position shown in FIG. 8B, the cap unit 10 has been moved vertically downward and the wiping unit 17 has been drawn from the maintenance unit 16. The wiping unit 17 comprises two wiper units: a blade wiper unit 171 and a vacuum wiper unit 172.

In the blade wiper unit 171, blade wipers 171*a* for wiping the ejection opening surface 8*a* in the x-direction are provided in the y-direction by the length of an area where the ejection openings are arrayed. In the case of performing wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink and the like adhering to the ejection opening surface 8*a*.

The entrance of the maintenance unit 16 through which the blade wipers 171*a* are housed is equipped with a wet wiper cleaner 16*a* for removing ink adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction, a carriage 172*b* movable in the y-direction within the opening, and a vacuum wiper 172*c* mounted on the carriage 172*b*. The vacuum wiper 172*c* is provided to wipe the ejection opening surface 8*a* in the y-direction along with the movement of the carriage 172*b*. The tip of the vacuum wiper 172*c* has a suction opening connected to the suction pump (not shown). Accordingly, if the carriage 172*b* is moved in the y-direction while operating the suction pump, ink and the like adhering to the ejection opening surface 8*a* of the print head 8 are wiped and gathered by the vacuum wiper 172*c* and sucked into the suction opening. At this time, the flat plate 172*a* and a dowel pin 172*d* provided at both ends of the opening are used to align the ejection opening surface 8*a* with the vacuum wiper 172*c*.

In the present embodiment, it is possible to carry out a first wiping process in which the blade wiper unit 171 performs wiping operation and the vacuum wiper unit 172 does not perform wiping operation and a second wiping process in which both the wiper units sequentially perform wiping operation. In the case of the first wiping process, the print controller 202 first draws the wiping unit 17 from the maintenance unit 16 while the print head 8 is evacuated vertically above the maintenance position shown in FIG. 7. The print controller 202 moves the print head 8 vertically downward to a position where the print head 8 can be in contact with the blade wipers 171*a* and then moves the wiping unit 17 into the maintenance unit 16. This movement enables the blade wipers 171*a* to wipe ink and the like adhering to the ejection opening surface 8*a*. That is, the blade wipers 171*a* wipe the ejection opening surface 8*a* when moving from a position drawn from the maintenance unit 16 into the maintenance unit 16.

After the blade wiper unit 171 is housed, the print controller 202 moves the cap unit 10 vertically upward and brings the cap member 10*a* into intimate contact with the ejection opening surface 8*a* of the print head 8. In this state, the print controller 202 drives the print head 8 to perform preliminary ejection and allows the suction pump to suck ink collected in the cap member 10*a*.

In the case of the second wiping process, the print controller 202 first slides the wiping unit 17 to draw it from the maintenance unit 16 while the print head 8 is evacuated vertically above the maintenance position shown in FIG. 7. The print controller 202 moves the print head 8 vertically downward to the position where the print head 8 can be in contact with the blade wipers 171*a* and then moves the wiping unit 17 into the maintenance unit 16. This movement enables the blade wipers 171*a* to perform wiping operation for the ejection opening surface 8*a*. Next, the print controller 202 slides the wiping unit 17 to draw it from the maintenance unit 16 to a predetermined position while the print head 8 is evacuated again vertically above the maintenance position shown in FIG. 7. Then, the print controller 202 uses the flat plate 172*a* and the dowel pins 172*d* to align the ejection opening surface 8*a* with the vacuum wiper unit 172 while moving the print head 8 down to a wiping position shown in FIG. 7. After that, the print controller 202 allows the vacuum wiper unit 172 to perform the wiping operation described above. After evacuating the print head 8 vertically upward and housing the wiping unit 17, the print controller 202 allows the cap unit 10 to perform preliminary ejection into the cap member and suction operation of collected ink in the same manner as the first wiping process.

First Embodiment

Figure 9A:
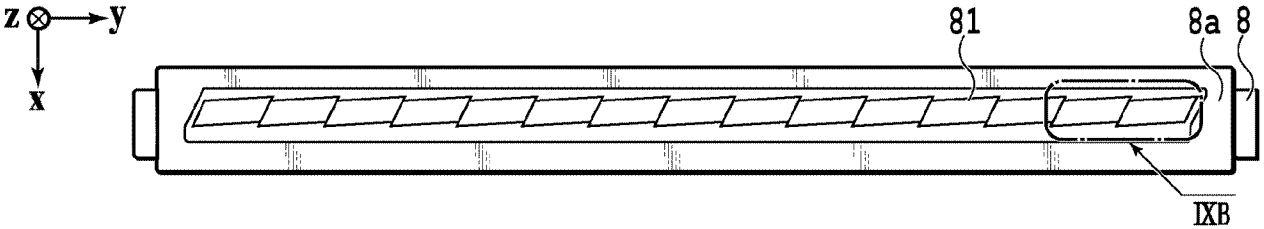
FIGS. 9A to 9D are diagrams showing a positional relation between a print head and a cap unit.

FIGS. 9A to 9D are diagrams for illustrating a positional relationship between the print head 8 of a full-line type and the cap unit 10 on the xy-plane in the present embodiment. FIG. 9A is a perspective view of the ejection opening surface 8*a* of the print head 8 as viewed from the top in the vertical direction. On the ejection opening surface 8*a*, fifteen printing element substrates 81, each being a parallelogram, are arranged in the y-direction, while short sides of the parallelograms are in contact with each other.

Figure 9B:
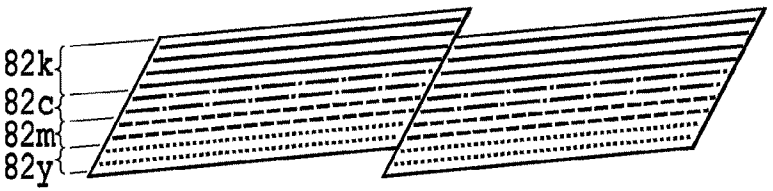

FIG. 9B is an enlarged view of an area surrounded in IXb of FIG. 9A and shows two adjacent printing element substrates 81. On each printing element substrate 81, four ejection opening arrays 82*k* for ejecting black ink, two ejection opening arrays 82*c* for ejecting cyan ink, two ejection opening arrays 82*m* for ejecting magenta ink, and two ejection opening arrays 82*y* for ejecting yellow ink are arranged as shown in the figure. On each ejection opening array, ejection openings for ejecting ink as droplets are arranged at predetermined pitches, and its arrangement direction is inclined with respect to the y-direction.

In the present embodiment, there are prepared a black mode focusing on black text quality and a color mode focusing on image reproducibility. Black ink mainly used in the black mode is designed to have a higher color material concentration than other color inks. Accordingly, black ink has a viscosity higher than that of color ink and tends to easily stagnate in the absorber. Furthermore, since high-speed outputting is required in the black mode, more ejection opening arrays 82 are prepared for the black ink compared to the other color inks.

Figure 9C:
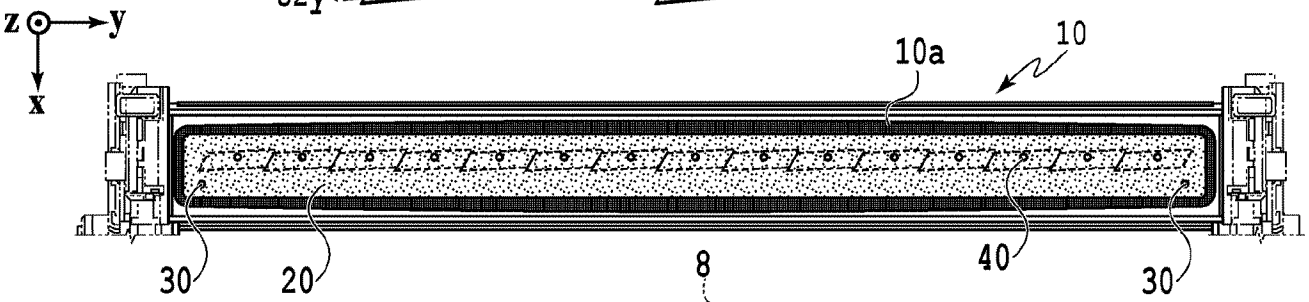

Meanwhile, FIG. 9C is a top view of the cap unit 10 for capping the ejection opening surface 8*a* shown in FIG. 9A. The cap unit 10 is provided with a cap member 10*a* in a frame shape that can be in intimate contact with the ejection opening surface 8*a*, and further, an absorber 20 which is a porous body is housed inside the cap member 10*a*. Furthermore, on a bottom surface of the cap member 10*a*, there are formed two atmosphere communication ports 30 and fifteen suction openings 40 aligned at predetermined intervals in the y-direction.

In FIG. 9C, an area surrounded by a dotted line indicates an area where the cap member 10*a* faces the fifteen printing element substrates 81 in coming into intimate contact with the ejection opening surface 8*a*. Since the cap member 10*a* comes into intimate contact with the ejection opening surface 8*a* so as to entirely cover the printing element substrates 81, wiring connected to the printing element substrates 81, and a sealing material 60 protecting the wiring, the position of the printing element substrates 81 indicated by the dotted line is displaced in the −x-direction from the center of the cap member 10*a*. In addition, a suction opening 40 of the present embodiment is provided in a position facing the ejection opening arrays 82*k* for black ink for each of the printing element substrates 81. Accordingly, each suction opening 40 is located in a position further displaced in the −x-direction from the center of the cap member 10*a* in the x-direction.

Figure 9D:
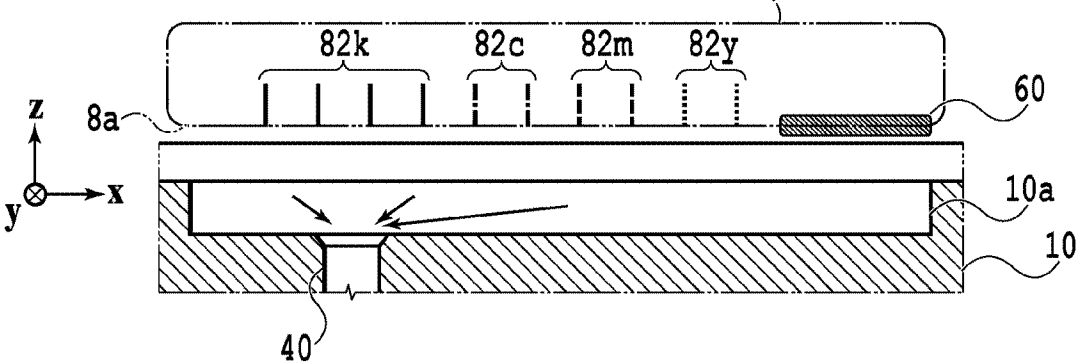

FIG. 9D is an enlarged cross-sectional view of a state where the cap member 10*a* faces the ejection opening surface 8*a*. The cap member 10*a* faces the ejection opening surface 8*a* so as to cover the ejection opening arrays 82*k*, 82*c*, 82*m*, 82*c* and the sealing material 60. In the present embodiment, maintenance processing for maintaining ejection performance is performed basically in the positional relation shown in FIG. 9D. That is, suction recovery operation for driving a suction pump and forcibly discharging ink from ejection openings in a state where the cap member 10*a* is in intimate contact with the ejection opening surface and preliminary ejecting operation for causing the print head 8 to perform preliminary ejection and then suction are both performed in the positional relation shown in FIG. 9D. Accordingly, inks of respective colors move through the absorber 20 from the respective positions facing the ejection opening arrays 82*k*, 82*c*, 82*m*, 82*y* toward the suction opening 40.

At this time, as described above, in the present embodiment, black ink has a higher color material concentration than other inks and tends to easily thicken even in the same evaporation environment. For this reason, it is very likely that, in an area of the absorber 20 where black ink lands and passes, ink will stagnate or accumulate as compared to an area of the absorber 20 where other color inks land and pass. Accordingly, in the present embodiment, the suction opening 40 is provided in the position facing the ejection opening arrays 82*k* for black ink so that a suction force acting on the area of the absorber 20 where black ink passes is set higher compared to the other area. This allows black ink to be discharged from the cap member 10*a* with higher priority. As a result, accumulation of black ink in the absorber 20 can be suppressed, thereby allowing the entire inks in the cap to be sucked evenly and efficiently removed from the cap.

Second Embodiment

Figure 10:
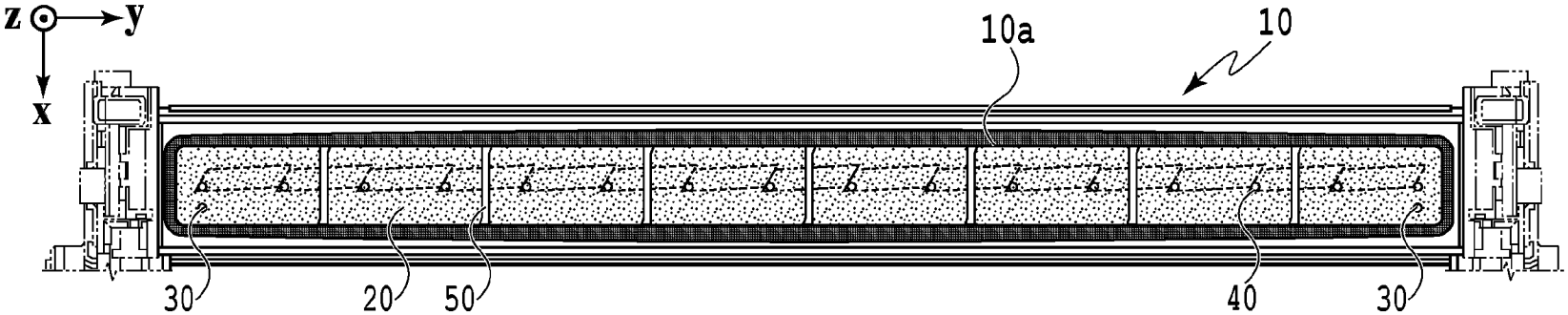
FIG. 10 is a top view of the cap unit used in a first embodiment.

FIG. 10 is a top view of the cap unit 10 used in the present embodiment. In the cap unit 10 of the present embodiment, a plurality of ribs 50 extending in the x-direction are provided inside the cap member 10*a*, and the inside of the cap member 10*a* is divided into eight sections in the y-direction. In each of the divided sections, an individual absorber 20 is housed. Preparing individual absorbers 20 in this manner allows retaining ink in each absorber 20 even if the entire apparatus tilts or the cap unit 10 is removed from the apparatus, and the collected ink can be prevented from leaking out of the lower end of the cap unit 10. It should be noted that in the present embodiment, the ribs 50 are provided in the positions that do not overlap with the boundaries between the adjacent printing element substrates 81, and every divided section includes two suction openings 40.

In FIG. 10, an area surrounded by a dotted line shows an area where the cap member 10*a* faces fifteen printing element substrates 81 in coming into intimate contact with the ejection opening surface 8*a* of the print head 8. Also in the present embodiment, since the cap member 10*a* comes into intimate contact with the ejection opening surface 8*a* so as to entirely cover the printing element substrates 81 and the sealing material 60, the position of the printing element substrates 81 indicated by the dotted line is displaced in the −x-direction from the center of the cap member 10*a*.

Figure 11:
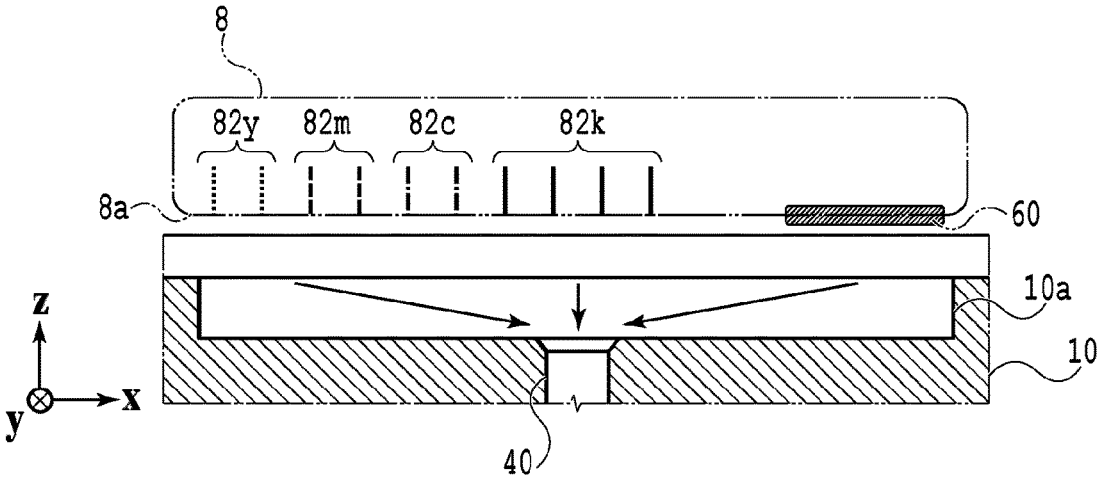
FIG. 11 is an enlarged cross-sectional view of a cap member and an ejection opening surface in a second embodiment.

FIG. 11 is an enlarged cross-sectional view of a state where the cap member 10*a* faces the ejection opening surface 8*a* in the present embodiment. In the present embodiment, the order of arrangement of the ejection opening arrays 82*k*, 82*c*, 82*m*, 82*c* are reversed from that in the first embodiment. The ejection opening arrays 82*k* for black ink are located in a position closest to the sealing material 60. Furthermore, the suction opening 40 is formed substantially in the center of the cap member 10*a* in the x-direction and in a position facing the ejection opening arrays 82*k* for black ink. Suction recovery operation for driving a suction pump and forcibly discharging ink from ejection openings in a state where the cap member 10*a* is in intimate contact with the ejection opening surface is performed in a positional relation shown in FIG. 11. Accordingly, forcibly discharged inks of respective colors move through the absorber 20 from the respective positions facing the ejection opening arrays toward the suction opening 40. Since a path in which black ink moves is shorter than a path in which the other inks move, a suction force acting on black ink is greater than a suction force acting on the other inks.

Meanwhile, referring back to FIG. 10, each of the plurality of suction openings 40 is formed in a position corresponding to a left end portion of the printing element substrate 81 in the y-direction. The reason why the suction opening 40 is located in such a position is that the printing apparatus of the present embodiment performs characteristic preliminary ejecting operation called an overlapping preliminary ejection sequence. Hereinafter, the overlapping preliminary ejection sequence will be described in detail.

Figures 12A, 12B, 12C:
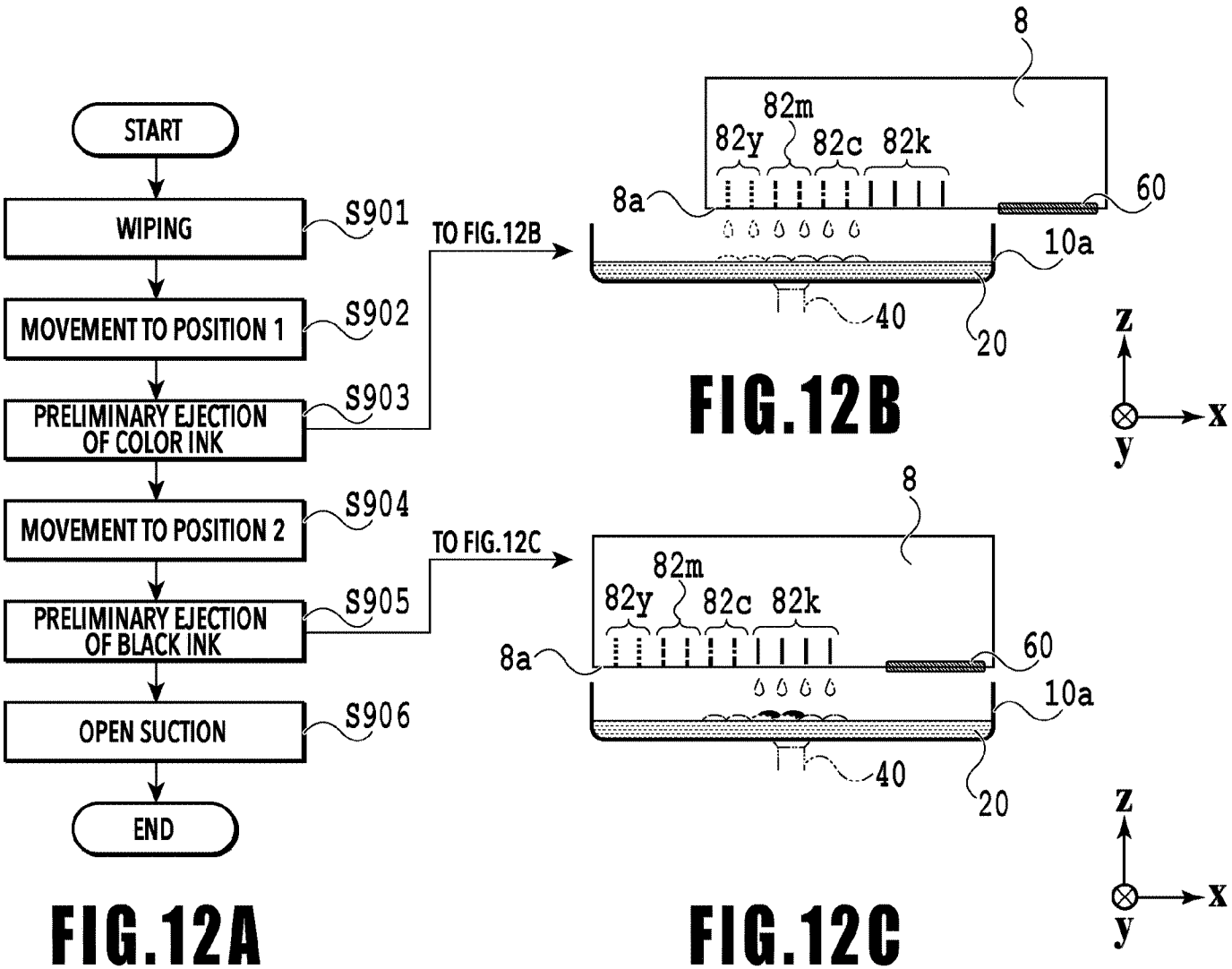
FIGS. 12A to 12C are a flowchart and diagrams illustrating an overlapping preliminary ejection sequence.

FIGS. 12A to 12C are a flowchart of the overlapping preliminary ejection sequence and diagrams illustrating an operating state of overlapping preliminary ejection. After the process begins, the print controller 202 causes the maintenance control unit 210 to execute a predetermined wiping process in step S901. More specifically, the print controller 202 causes the maintenance control unit 210 to execute either the above-described first wiping process or second wiping process.

In step S902, the print controller 202 locates the print head 8 and the cap unit 10 in a first relative position (position 1) and, in the following step S903, performs preliminary ejection of color ink. The position 1 represents a relative positional relation shown in FIG. 12B, where preliminarily ejected color ink lands substantially in the center of the absorber 20 in the cap member 10*a* in the x-direction.

If the preliminary ejecting operation of color ink in step S903 is completed, the process proceeds to step S904 and the print controller 202 locates the print head 8 and the cap unit 10 in a second relative position (position 2). The position 2 is a position representing the positional relation between the print head 8 and the cap unit 10 that have moved from the position 1 in the x-direction. That is, the relative position between the print head 8 and the cap unit 10 is moved along a direction crossing the ejection opening arrays 82 of the print head 8. Then, the process proceeds to step S905 and the print controller 202 performs preliminary ejection of black ink. The position 2 is a position shown in FIG. 12C, where preliminarily ejected black ink lands on an area that is substantially the same as the area on the absorber where color ink was absorbed in step S903.

After the preliminary ejection of black ink is performed in step S905, the process proceeds to step S906 and the print controller 202 performs open suction. More specifically, the print controller 202 drives a pump connected to the suction opening 40 in a state where the inside of the cap member 10*a* is in communication with atmosphere. This causes the ink absorbed by the individual absorber 20 to be discharged from the inside of the cap member 10*a*. Then, the overlapping preliminary ejection sequence is finished.

According to the above-described overlapping preliminary ejection sequence, black ink that may relatively easily stagnate is received by the absorber 20 in the area where color ink that may not relatively easily stagnate has already been absorbed. Accordingly, stagnation of black ink in the absorber 20 can be suppressed by color ink, thereby maintaining flowability of black ink.

It should be noted that even in a case where the above-described overlapping preliminary ejection sequence has been performed, using the printing element substrates 81 of the present embodiment may cause an area where preliminarily ejected black ink is received but preliminarily ejected color ink is not received in some areas of the absorbers 20.

Figure 13:
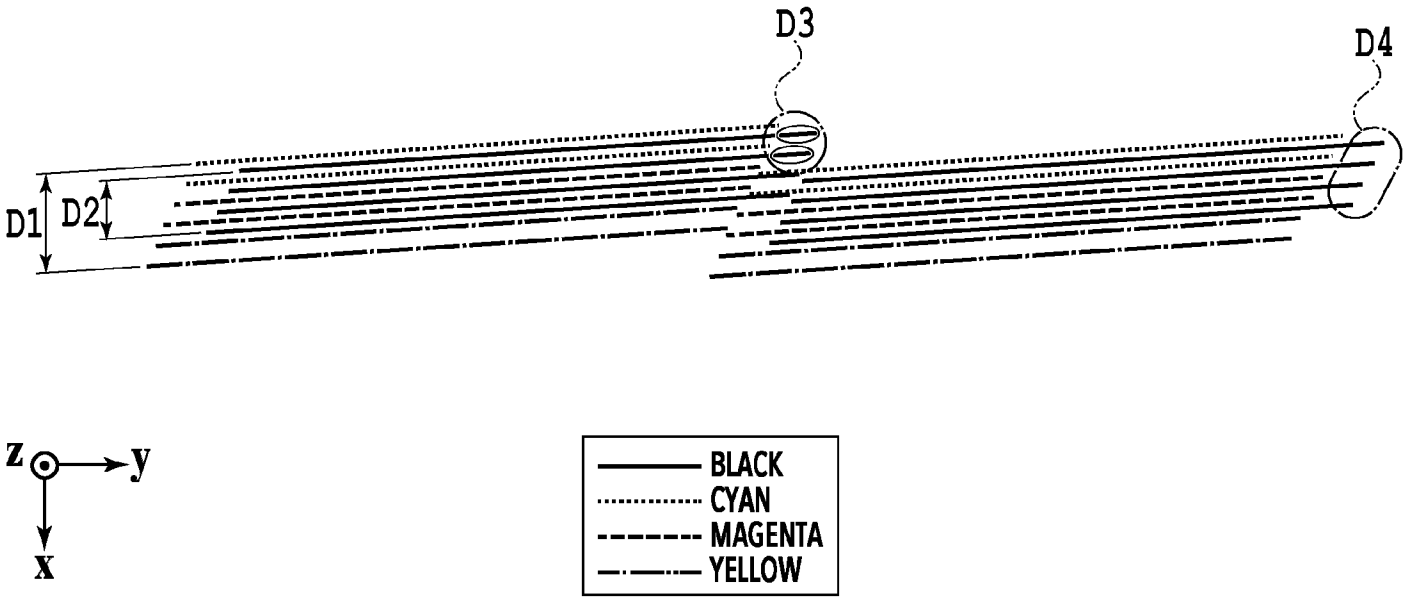
FIG. 13 is a diagram showing in detail a position in which ink of each color is received in an absorber.

FIG. 13 is a diagram showing in detail a position in which ink of each color is received in the absorber 20. FIG. 13 shows areas, for respective ink colors, to which inks respectively ejected from the ejection opening arrays 82*k*, 82*c*, 82*m*, 82*y* are applied in the overlapping preliminary ejection sequence.

In FIG. 13, an area D1 in the x-direction shows an area to which color ink is applied from the ejection opening arrays 82*c*, 82*m*, 82*y* in step S903. Meanwhile, an area D2 shows an area to which black ink is applied from the ejection opening arrays 82*k* in step S905. Now, focusing on an area D3 corresponding to a boundary between two adjacent printing element substrates 81 in the y-direction, this area corresponds to an area to which color ink is not applied in step S903 and black ink is applied in step S905. Furthermore, regarding an area D4 which corresponds to an end portion in the y-direction of the printing element substrate 81 located at the end among fifteen printing element substrates 81 arranged in the y-direction, this area is also an area to which color ink is not applied in step S903 and black ink is applied in step S905. Accordingly, in the areas D3 and D4, the effect of the overlapping preliminary ejection sequence cannot be sufficiently obtained compared to the other areas, and black ink may thicken or stagnate.

In consideration of such a situation, in the present embodiment, as shown in FIG. 10, the suction opening 40 is provided in a position corresponding to the areas D3 and D4, so that inks in those areas are removed from the cap member

10*a* with higher priority. As a result, the entire inks in the cap are sucked evenly, allowing the inks to be efficiently removed from the cap.

Incidentally, it can be said that a suction force within each of the divided sections depends on a position where the suction opening 40 is provided, and its dependency increases as a volume of the divided section decreases. Providing two suction openings substantially in the center of each divided section in the x-direction like the present embodiment allows the suction force to be substantially equalized uniformly not only in each divided section but also across the plurality of divided sections. As for the suction opening 40, however, it is not always needed to provide the same number of suction openings 40 in the plurality of divided sections. Each divided section may have at least one suction opening on a condition of an area where preliminarily ejected black ink is received but preliminarily ejected color ink is not received. Accordingly, stagnation of black ink can be suppressed and black ink can be sucked with higher priority. As a result, the entire inks in the cap are sucked evenly, allowing the inks to be efficiently removed from the cap.

Incidentally, in the above embodiments, the present invention has been described based on the assumption that black ink has a higher color material concentration than other color inks and tends to easily thicken and stagnate in the absorber even in the same evaporation environment. However, the present invention is not limited to this example. For instance, in a case where cyan ink is ink that may most easily stagnate, a suction opening may be provided in an area where preliminarily ejected cyan ink is received but other preliminarily ejected inks are not received. Furthermore, for the same black ink, a first ink of pigment ink and a second ink of dye ink may be used. In either case, with a configuration that the same cap member receives, from the same print head, ink that may relatively easily stagnate and ink that may not relatively easily stagnate, the present invention functions effectively.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-133585 filed Jul. 7, 2017, which is hereby incorporated by reference wherein in its entirety.

What is claimed is:

1. An inkjet printing apparatus comprising:

a print head having an ejection opening surface on which first ejection openings for ejecting a first ink and second ejection openings for ejecting a second ink are arranged, the second ink having a higher viscosity compared to the first ink;

a cap member capable of capping the ejection opening surface;

an absorber located in the cap member for absorbing ink discharged from the first ejection openings and the second ejection openings;

a suction opening formed on the cap member for discharging ink absorbed by the absorber, the suction opening being formed on the cap member in a position where the suction opening does not face a region in which the first ejection openings are arranged and faces a region in which the second ejection openings are arranged in a case where the cap member caps the ejection opening surface; and a preliminary ejection unit configured to (i) perform a first preliminary ejection operation for preliminarily ejecting the first ink in a state where the ejection opening surface and the cap member are located in a first relative position where the suction opening faces a region in which the first ejection openings are arranged and (ii) perform a second preliminary ejection operation for preliminarily ejecting the second ink in a state where the ejection opening surface and the cap member are located in a second relative position where the suction opening faces a region in which the second ejection openings are arranged.

2. The inkjet printing apparatus according to claim 1, wherein the preliminary ejection unit performs the first preliminary ejection operation and then performs the second preliminary ejection operation.

3. The inkjet printing apparatus according to claim 1, further comprising a suction unit connected to the suction opening, the suction unit being configured to perform a suction operation for discharging the first ink and the second ink absorbed by the absorber in a state where the ejection opening surface is capped by the cap member.

4. The inkjet printing apparatus according to claim 1, wherein a plurality of substrates are arrayed in a first direction on the ejection opening surface, each substrate having a first ejection opening array in which the first ejection openings are arranged and a second ejection opening array in which the second ejection openings are arranged, and the suction opening is formed in a position corresponding to a boundary area between the adjacent substrates in a case where the cap member caps the ejection opening surface.

5. The inkjet printing apparatus according to claim 4, wherein the first ejection openings of the first ejection opening array and the second ejection openings of the second ejection opening array are arranged in a direction different from the first direction.

6. The inkjet printing apparatus according to claim 4, wherein an inside of the cap member and the absorber are divided into a plurality of sections by ribs in the first direction, and each of the plurality of sections has at least one suction opening.

7. The inkjet printing apparatus according to claim 6, wherein the rib is provided in a position where the rib does not face a boundary between the adjacent substrates in a case where the cap member caps the ejection opening surface.

8. The inkjet printing apparatus according to claim 1, wherein the first ink is color ink and the second ink is black ink.

9. The inkjet printing apparatus according to claim 1, wherein the first ink is dye ink and the second ink is pigment ink.

10. The inkjet printing apparatus according to claim 1, wherein the ejection opening surface is capped by the cap member in a case where the ejection opening surface and the cap member are located in the second relative position.

11. The inkjet printing apparatus according to claim 1, wherein on the ejection opening surface, the first ejection openings and the second ejection openings are arranged in an area corresponding to a width of a print medium.

* * * * *